US009636843B2

(12) United States Patent
Matye

(10) Patent No.: US 9,636,843 B2
(45) Date of Patent: May 2, 2017

(54) MOBILE CONCRETE MIXING PLANT

(71) Applicant: Reinhard Matye, Charlevoix, MI (US)

(72) Inventor: Reinhard Matye, Charlevoix, MI (US)

( * ) Notice: Subject to any disclaimer, the term of this patent is extended or adjusted under 35 U.S.C. 154(b) by 458 days.

(21) Appl. No.: 13/625,491

(22) Filed: Sep. 24, 2012

(65) Prior Publication Data

US 2013/0265843 A1 Oct. 10, 2013

Related U.S. Application Data

(63) Continuation-in-part of application No. 12/434,342, filed on May 1, 2009, now abandoned.

(60) Provisional application No. 61/049,951, filed on May 2, 2008.

(51) Int. Cl.

| | |
|---|---|
| ***B28C 5/08*** | (2006.01) |
| ***B28C 7/06*** | (2006.01) |
| ***B28C 7/08*** | (2006.01) |
| ***B28C 7/16*** | (2006.01) |
| ***B28C 9/04*** | (2006.01) |
| ***B28C 5/20*** | (2006.01) |

(52) U.S. Cl.

CPC ..... *B28C 5/0893* (2013.01); *B28C 5/2072* (2013.01); *B28C 7/064* (2013.01); *B28C 7/0835* (2013.01); *B28C 7/162* (2013.01); *B28C 9/0481* (2013.01)

(58) Field of Classification Search

CPC ..... B28C 5/20; B28C 7/064; B28C 9/04
USPC ..... 366/6, 41
See application file for complete search history.

(56) References Cited

U.S. PATENT DOCUMENTS

| | | | | |
|---|---|---|---|---|
| 2,234,210 | A * | 3/1941 | Wagner | B28C 5/4241 366/26 |
| 3,415,498 | A | 12/1968 | Zaccaron | |
| 3,888,468 | A | 6/1975 | Albin | |
| 4,039,086 | A * | 8/1977 | Ray | B66C 11/16 212/278 |
| 4,171,194 | A | 10/1979 | Goretti | |
| 4,311,395 | A | 1/1982 | Douthitt et al. | |
| 4,907,890 | A | 3/1990 | Lepper | |
| 4,997,284 | A | 3/1991 | Tousignant et al. | |
| 5,474,379 | A | 12/1995 | Perry | |
| 5,730,523 | A | 3/1998 | Flood | |
| 6,186,654 | B1 | 2/2001 | Gunteret, Jr. et al. | |

(Continued)

FOREIGN PATENT DOCUMENTS

| | | |
|---|---|---|
| FR | 2408444 | 7/1979 |
| FR | 2651445 | 3/1991 |
| FR | 2718667 | 10/1995 |

(Continued)

*Primary Examiner* — Robert J Grun
(74) *Attorney, Agent, or Firm* — Gardner, Linn, Burkhart & Flory, LLP

(57) ABSTRACT

A transportable concrete mixing plant is provided and includes a frame, a mixing drum for mixing concrete, a conveying system having at least one rail for moving a pre-measured quantity of premix concrete to the mixing drum, and a supply hopper for directing the pre-measured premix concrete into the mixing drum. The rail forms a support track that is traversed by the supply hopper, which travels from a dispensing position near the mixing drum to a loading position spaced from the mixing drum. Optionally, a concrete pump dispenses flowable concrete received from the mixing drum and pumps it to a remote location, such as a work site.

23 Claims, 11 Drawing Sheets

(56) References Cited

U.S. PATENT DOCUMENTS

2010/0118640 A1 5/2010 Matye et al.

FOREIGN PATENT DOCUMENTS

| | | |
|---|---|---|
| FR | 2832349 | 5/2003 |
| JP | 2006123285 | 5/2006 |
| RU | 2079409 | 5/1997 |
| WO | 2006046438 | 5/2006 |

* cited by examiner

MOBILE CONCRETE MIXING PLANT

The present application is a continuation-in-part of U.S. patent application Ser. No. 12/434,342, filed May 1, 2009, which claims the benefit of U.S. provisional application Ser. No. 61/049,951, filed May 2, 2008, both of which are hereby incorporated herein by reference in their entireties.

FIELD OF THE INVENTION

The present invention relates to concrete mixing plants and, more particularly, to transportable concrete mixing plants.

BACKGROUND OF THE INVENTION

Mobile concrete mixing plants are typically sized to fit on a roadable trailer, or are made up of assembled components that can be disassembled from one another and individually transported by road, such as on a semi-trailer. Typically, mobile concrete mixing plants are temporarily set up in a location near an immediate need for wet concrete, such as alongside a new road or a building project. The mobile mixing plant is supplied with concrete ingredients, such as cement, sand, aggregate, and water, which are mixed together in desired proportions and dispensed as flowable concrete.

SUMMARY OF THE INVENTION

The present invention provides a substantially self-contained transportable concrete mixing plant mounted on a roadable trailer. The transportable mixing plant may be positioned on a non-level support surface and leveled to compensate for the support surface. The transportable mixing plant receives dry concrete premix, mixes the premix with water to form liquid or flowable concrete, and dispenses the flowable concrete into a receptacle or pumps the flowable concrete to a location that is remote from the mixing plant.

According to one form of the present invention, a transportable concrete mixing apparatus is provided for supplying mixed flowable/pourable/liquid concrete in a substantially continuous manner. The apparatus includes a transport frame, a mixing drum coupled to the transport frame, a movable supply hopper, a support track, and a drive system. The supply hopper receives, contains, transports, and dispenses dry premix concrete, and includes a dispensing portion for selectively dispensing the dry premix concrete into the mixing drum. The support track movably supports the supply hopper, and includes a loading end portion spaced laterally away from the mixing drum and the transport frame, and a dispensing end portion positioned near the mixing drum. The drive system is associated with the support track and is capable of moving the supply hopper between the loading and dispensing end portions of the track. The movable supply hopper is capable of dispensing the premix concrete into the mixing drum when the supply hopper is at the dispensing end portion of the support track.

In one aspect, the apparatus further includes a base frame pivotally coupled to the transport frame. The mixing drum is mounted at the base frame. Optionally, the transport frame is a wheeled trailer frame to facilitate conveying the apparatus along a road surface. In addition, the apparatus may include an actuator for pivoting the base frame with respect to the transport frame, such as for pivoting the base frame to a level orientation when the transport frame is oriented at a non-level orientation.

In another aspect, the drive system includes a winch at the support track. The winch may be supported at the support track, and include a cable that is coupled to the supply hopper, and that is windable and unwindable from the winch.

In yet another aspect, the apparatus includes a concrete auger or pump. The mixing drum is operable to dispense flowable concrete into the concrete auger or pump, and the concrete auger or pump is operable to move the flowable concrete to a location spaced remotely from the apparatus.

In still another aspect, the apparatus includes a pair of pivotally mounted mixing drums. Each of the mixing drums is pivotable between a mixing orientation and a dispensing orientation. Optionally, the mixing drums can alternately mix concrete and dispense mixed flowable concrete into the concrete auger or pump, such as to provide a substantially continuous supply of mixed flowable concrete.

In a further aspect, a water tank is provided for supplying the water to the mixing drum and wetting the premix concrete for forming the mixed flowable concrete.

In a still further aspect, the apparatus includes a hydraulic motor for rotating the mixing drum about a longitudinal axis. Optionally, the apparatus further includes a hydraulic pump for driving the hydraulic motor, and electric motor for driving the hydraulic pump, and an electrical generator for generating electricity to energize the electric motor.

In another aspect, the movable supply hopper includes a carriage for engaging the support track, and for movably supporting the movable supply hopper along the support track. Optionally, the carriage includes a plurality of wheels for rolling along the support track as the supply hopper moves in response to the drive system.

In another aspect, the support track is arranged at an incline such that its dispensing end portion is positioned at a higher elevation than its loading end portion.

According to another form of the present invention, a transportable concrete mixing apparatus includes a transport frame, a mixing drum, a conveying system, and a supply hopper. The mixing drum is coupled to the transport frame and is operable to receive a pre-measured quantity of premix concrete. The mixing drum is further operable to mix the premix concrete with water to form mixed flowable concrete, and to dispense the mixed flowable concrete. The conveying system includes at least one rail and is operable to move the pre-measured quantity of premix concrete from a location remote from the mixing drum, onto the transport frame, and to a location near the mixing drum. The supply hopper includes a dispensing portion for directing the pre-measured quantity of premix concrete from the conveying system and into the mixing drum.

In one aspect, the supply hopper is a stationary hopper that positioned near the mixing drum, and the rail is an overhead rail positioned above the mixing drum. The mixing apparatus further includes a carriage assembly movably supported at the overhead rail, and a winch at the carriage assembly. The carriage assembly is configured to support a container that contains the pre-measured quantity of premix concrete. The winch is configured to raise and lower the container of premix concrete.

In another aspect, the rail is an inclined support track having a loading end portion spaced laterally away from the mixing drum and a dispensing end portion positioned proximate the mixing drum, and the supply hopper is movably supported by the support track. The mixing apparatus further includes a drive system associated with the support track. The drive system is configured to move the movable supply hopper between the loading and dispensing end portions of the support track. The supply hopper is configured to receive the pre-measured quantity of premix concrete when the supply hopper is at the loading end portion of the support track, and is further configured to selectively dispense the pre-measured quantity of premix concrete into the mixing drum when the supply hopper is at the dispensing end portion of the support track.

According to another form of the present invention, a method is provided for preparing mixed flowable concrete. The method includes providing a transport frame, a mixing drum coupled to the transport frame, a support track, a supply hopper movably supported at the support track, and a drive system. The support track is positioned with a loading end portion of the support track spaced laterally away from the mixing drum, and a dispensing end portion of the support track positioned above at least a portion of the mixing drum. The supply hopper is positioned at the loading end portion of the support track. The contents of a container of premix concrete are dispensed from the container into the supply hopper. The supply hopper is moved to the dispensing end portion of the support track by the drive system, and the premix concrete is dispensed from the support hopper into the mixing drum. The premix concrete is mixed with water in the mixing drum, and flowable concrete is then dispensed from the mixing drum.

In one aspect, the method includes providing two mixing drums. Optionally, dispensing the premix concrete from the supply hopper may include the steps of dispensing the premix concrete from the supply hopper into the first mixing drum, moving the supply hopper to the loading end portion of the support track with the drive system, providing a second container of premix concrete, dispensing the premix concrete from the second container into the supply hopper, moving the supply hopper to the dispensing end portion of the support track with the drive system, and dispensing the premix concrete from the supply hopper into the second mixing drum.

Optionally, dispensing the premix concrete from the supply hopper into the mixing drum includes the steps of dispensing only a portion of the premix concrete from the supply hopper into the first mixing drum, and then dispensing into the second mixing drum another portion of the premix concrete from the supply hopper.

Therefore, the transportable concrete mixing plant of the present invention provides a transportable and substantially self-contained concrete mixing plant that is capable of supplying a substantially constant supply of mixed flowable concrete. Further, the transportable mixing plant of the present invention may be positioned on uneven ground and may be used to pump flowable concrete to remote locations, thereby obviating the need for concrete-carrying vehicles.

These and other objects, advantages, purposes, and features of the present invention will become apparent upon review of the following specification in conjunction with the drawings.

DESCRIPTION OF THE PREFERRED EMBODIMENTS

Figure 1:
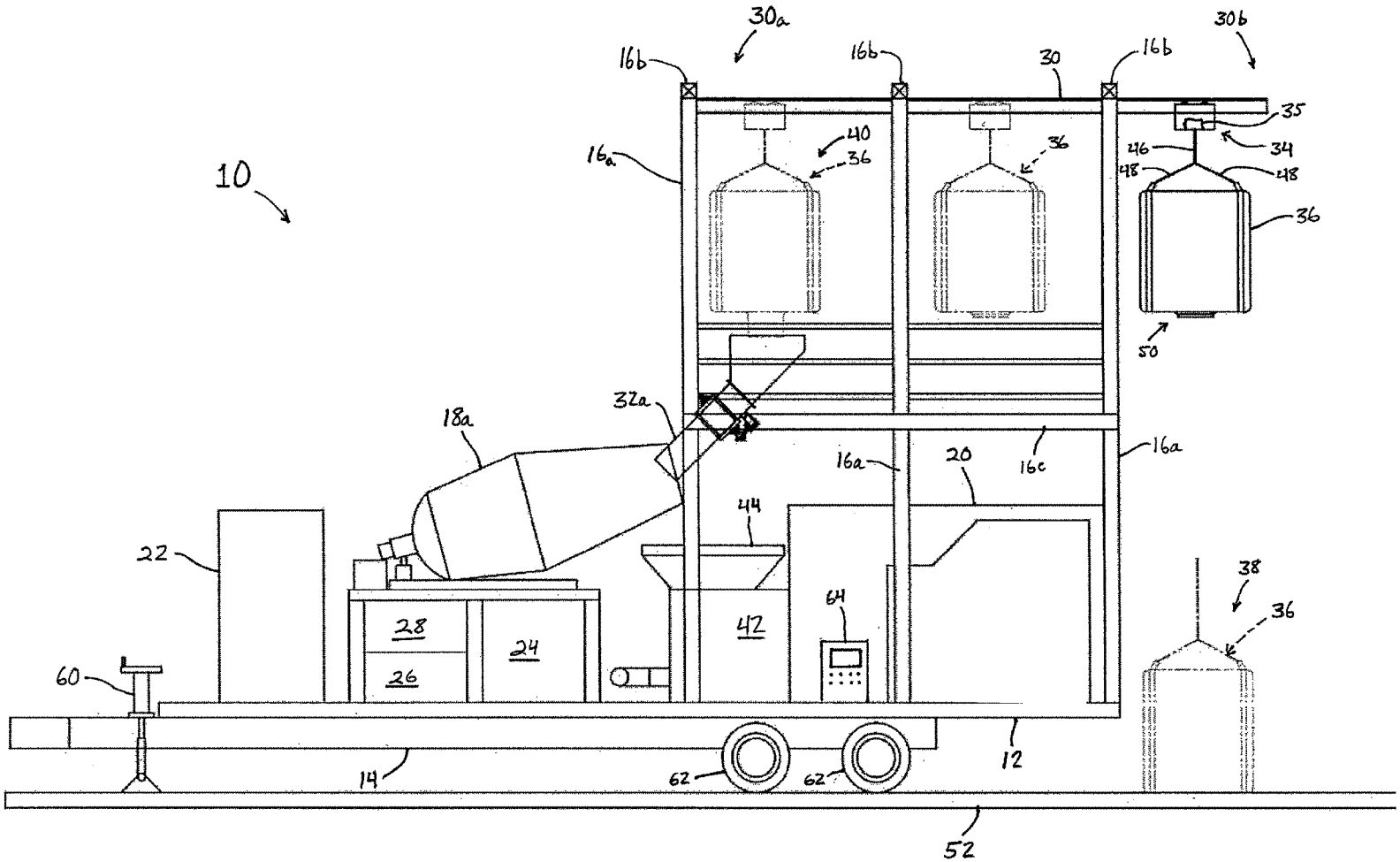
FIG. 1 is a side elevation of a transportable concrete mixing plant in accordance with the present invention, shown with the plant supported upon a level surface.

Referring now to the drawings and the illustrative embodiments depicted therein, a transportable concrete mixing plant 10 includes a base frame 12, a wheeled transport frame or trailer frame 14, and a superstructure frame assembly 16. Transportable concrete mixing plant 10 provides a substantially self-contained concrete mixing and dispensing facility that is readily transported, such as by road, to a location near a worksite. Plant 10 is operable to supply a substantially constant flow of mixed flowable concrete to a location spaced from the plant.

Figure 2:
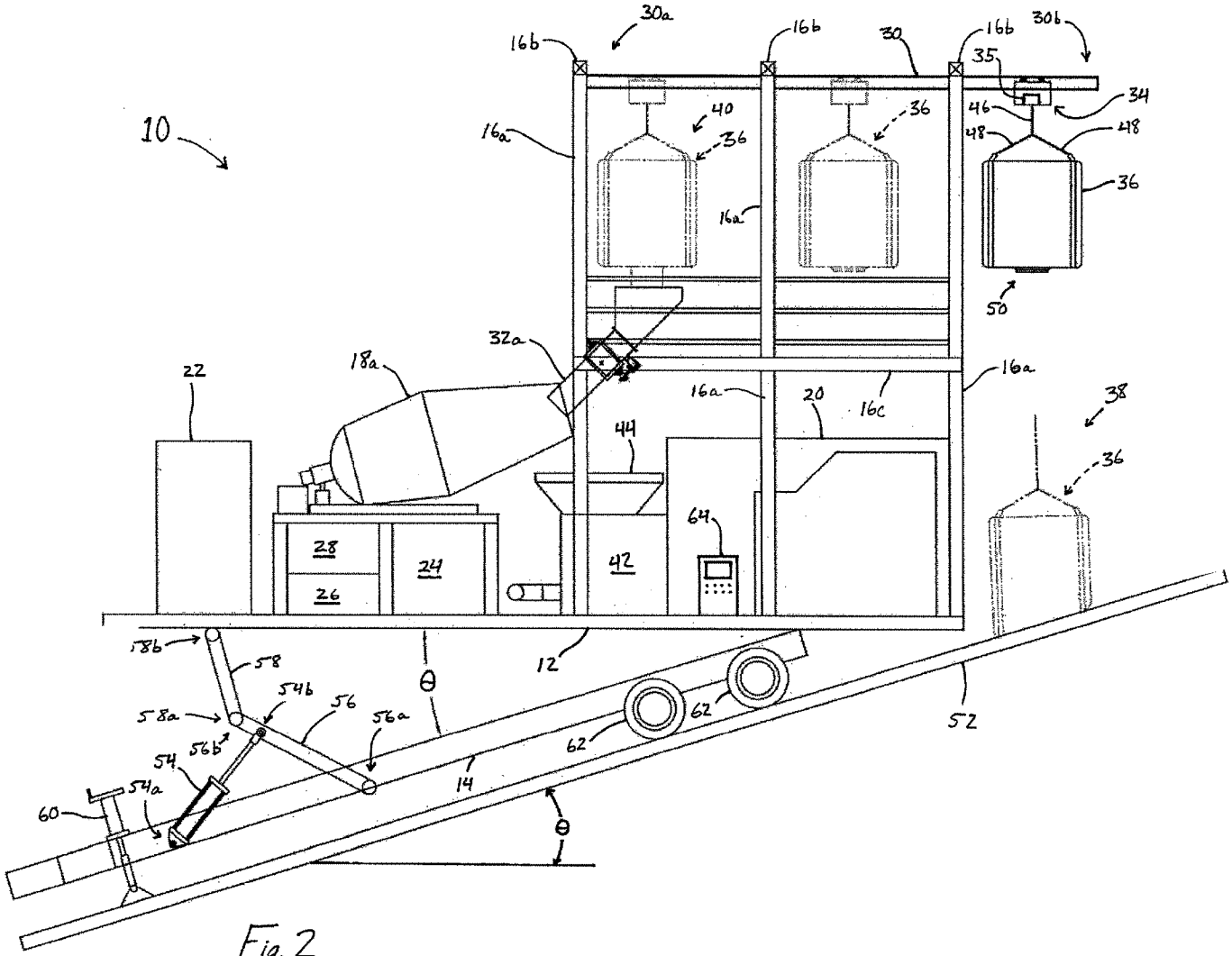
FIG. 2 is a side elevation of the plant of FIG. 1, positioned on a sloped support surface.

Base frame 12 supports a pair of mixing drums 18*a*, 18*b*, a concrete pump 20, an electrical generator 22, a hydraulic power unit 24, a water tank 26, and a fuel tank 28. Superstructure frame assembly 16, which is mounted to base frame 12 and extends upwardly therefrom, includes a plurality of vertical members 16*a*, horizontal cross-members 16*b*, and horizontal longitudinal members 16*c*. Superstructure frame assembly 16 supports an overhead rail 30 at horizontal cross-members 16*b* and further supports a pair of supply chutes 32*a*, 32*b*, each of which may be fed from a common supply hopper 33 (FIGS. 1 and 2). Optionally, a discharge actuator 35 may be positioned between supply hopper 33 and supply chutes 32*a*, 32*b* to control whether dry premix concrete (also referred to herein simply as "premix") is discharged through one or both of supply chutes 32*a*, 32*b*, and/or to control whether dry premix concrete is temporarily held in supply hopper 33 before being discharged. A carriage assembly 34 is movably mounted to overhead rail 30 for moving containers 36 of premix concrete from a loading location 38 to a discharge location 40, as will be described in greater detail below.

Figure 3:
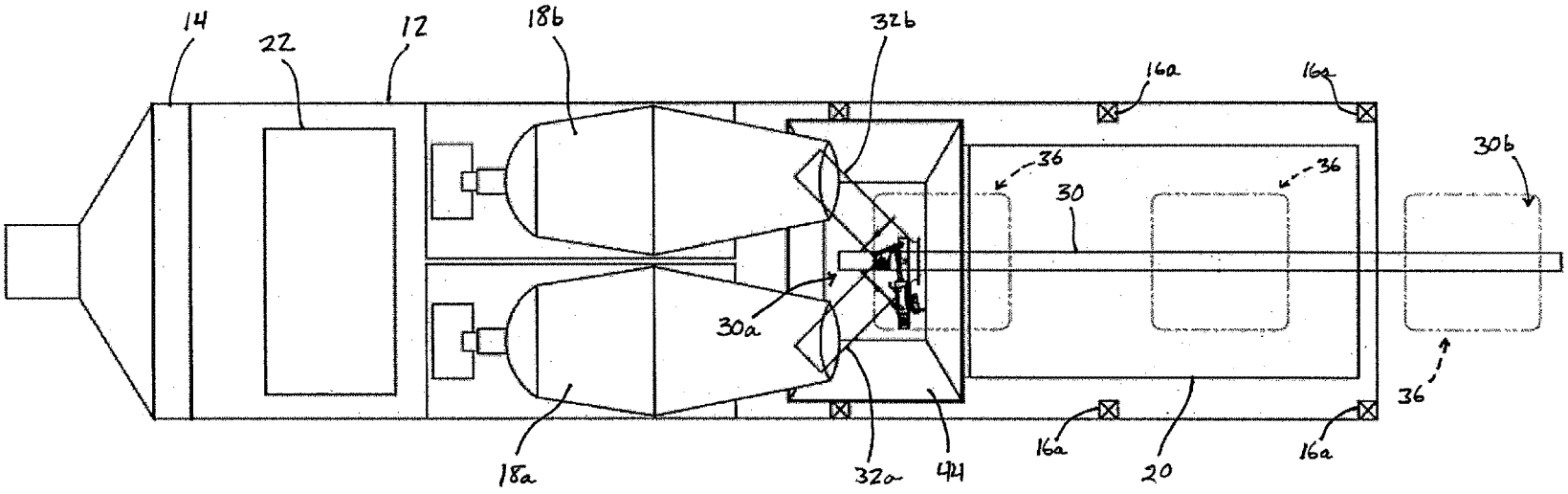
FIG. 3 is a top plan view of the transportable concrete mixing plant of FIG. 1.

Mixing drums 18*a*, 18*b* are positioned adjacent one another above base frame 12, with mixing drum 18*a* arranged as a left mixing drum and mixing drum 18*b* arranged as a right mixing drum when viewed from above or behind mixing plant 10. Mixing drums 18*a*, 18*b* are independently vertically pivotable (about a horizontal, laterally-aligned axis) between a loading/mixing position with their open ends directed upwardly and the dispensing position with their open ends lowered from the loading/mixing position (loading/mixing position shown). As best seen in FIG. 3, left mixing drum 18*a* is fed with dry premix concrete via supply chute 32*a*, and right mixing drum 18*b* is supplied by supply chute 32*b*. At their respective loading/mixing positions, mixing drums 18*a*, 18*b* are rotatably driven about their respective longitudinal axes to mix dry premix concrete, received from respective chutes 32*a*, 32*b*, with water supplied from water tank 26 until the mixture is thoroughly wetted and pourable or flowable. A metered quantity of water is pumped from water tank 26 into each drum through each drum's respective open end using a water pump. After the premix concrete and water are suitably mixed, the mixing drum is pivoted downwardly to the dispensing position, whereupon continued rotation of the drum urges the mixed and flowable or pourable concrete into a receiving hopper 42 via a funnel 44. Optionally, supply chutes 32*a*, 32*b* may include replaceable wear plates or liners to prevent excessive wear of the chutes.

In operation, mixing drums 18*a*, 18*b* are independently controlled so that while left mixing drum 18*a* is tilted upwardly for receiving premix and mixing the premix with water, right mixing drum 18*b* is tilted downwardly for dispensing mixed flowable concrete into receiving hopper 42. Optionally, the time required for receiving dried premix concrete and thoroughly mixing it with water may be approximately equal to the time required to dispense the flowable concrete contents of the mixing drum into receiving hopper 42, thereby facilitating substantially continuous flow of pourable or flowable concrete into hopper 42 by alternately mixing and dispensing from left mixing drum 18*a* and right mixing drum 18*b*.

Thus, mixing drums 18*a*, 18*b* may be alternately sequenced so that left mixing drum 18*a* is receiving or mixing dry premix from supply chute 32*a* while right mixing drum 18*b* is dispensing mixed flowable concrete into receiving hopper 42. When left mixing drum 18*a* has thoroughly mixed its contents with water to form mixed flowable concrete, left mixing drum 18*a* is tilted downwardly to dispense flowable concrete into receiving hopper 42 while right mixing drum 18*b* is tilted upwardly to receive its next load of dry premix. Each mixing drum 18*a*, 18*b* may be generally conventional in design, having helical mixing paddles or blades along an inner surface of each dram, whereby rotation in one direction draws concrete to the closed end of the drum for mixing, and rotation in the opposite direction directs flowable concrete toward the open end of the drum for dispensing. Mixing drums 18*a*, 18*b* may be one cubic yard capacity cement mixers, for example, and rotatably and pivotally driven by actuators powered by hydraulic power unit 24. Hydraulic power unit 24 may be a self-contained thirty horsepower unit driven by an electric motor powered by the generator 22, for example, or other suitable power unit.

Overhead rail 30 is supported centrally above base frame 12 by superstructure frame assembly 16 and permits the loading and positioning of containers 36 for dispensing dry premix concrete into one of mixing drums 18*a*, 18*b* via supply hopper 33 and supply chutes 32*a*, 32*b*. Rail 30 has a front end portion 30*a* positioned generally above supply chutes 32*a*, 32*b* and a rear end portion 30*b* opposite front end portion 30*a*. In the illustrated embodiment, overhead rail 30 is a monorail, such as an I-beam or a C-shaped beam that supports carriage assembly 34, and permits carriage assembly 34 to translate longitudinally along mixing plant 10. Rear end portion 30*b* of overhead rail 30 may extend rearwardly beyond a rearward extent of base frame 12 to facilitate the loading of containers 36, as will be described in greater detail below.

Carriage assembly 34 may be equipped with a manual or powered winch 35, such as an electric winch, having a cable 46 that engages lift straps 48 of container 36. Thus, carriage assembly 34 is operable to raise and lower cable 46 in order to raise and lower container 36. Winch 35 may be a 7.5 horsepower electric winch capable of raising and lowering cable 46 at about twenty-two feet-per-minute (22 f.p.m.), for example, or any other suitable powered winch.

Containers 36 may be made of woven fabric such as polypropylene fabric or the like, having square dimensions of 35 inches square by 51 inches high in order to hold at least about one cubic yard of dry premix concrete, although it will be appreciated that substantially any other type or size of container may be suitable. Lift straps 48 are sewn to the four corners of containers 36 and may incorporate loops to facilitate attachment of cable 46 thereto. Containers 36 include a closable bottom openings 50 that are normally held closed by a draw string or other closure device. The draw string is normally released when container 36 is positioned above supply chutes 32*a*, 32*b* to release dry premix concrete into one of mixing drums 18*a*, 18*b*. Such containers are available, for example, from DCL, Inc. of Charlevoix, Mich.

Concrete pump 20 is supplied with mixed flowable concrete from mixing drums 18*a*, 18*b* via receiving hopper 42 and is operable to pump the flowable concrete to a nearby location, such as a transport vehicle, or to a distant location, such as a worksite. For example, concrete pump 20 may be powered by a one hundred sixty horsepower diesel engine and capable of pumping approximately sixty cubic yards of flowable concrete per hour a horizontal distance of up to about 900 feet and a vertical distance of up to about 290 feet through a pipe (not shown) having a diameter of about five inches.

Electrical generator 22 provides electricity for operation of the entire transportable concrete mixing plant 10, such as for operating an electric motor to drive hydraulic power unit 24 (although hydraulic power unit 24 may alternatively be driven directly by an internal combustion engine, such as a diesel engine), to drive the electric winch 35 and carriage assembly 34, to power electric lights for night operation, and to power an optional control panel 64 for controlling the operation of mixing plant 10. For example, electrical generator 22 may be powered by a diesel engine to produce approximately eighty kilowatts of electricity, although it will be appreciated that more or less electrical energy capacity may be sufficient, depending on the size and energy needs of the mixing plant.

Water tank 26 supplies water to mixing drums 18*a*, 18*b* for mixing with dry premix concrete and producing flowable concrete therefrom. For example, water tank 26 may have a capacity of approximately 500 gallons, which is sufficient for mixing approximately 16 cubic yards of premix. A pump is provided for pumping water into mixing drums 18*a*, 18*b*. Fuel tank 28 supplies fuel, such as diesel fuel, to an engine associated with electrical generator 22, concrete pump 20, and any other internal combustion engine or fueled device located at mixing plant 10.

As best shown in FIG. 2, base frame 12 is pivotally supported at a rear end of trailer frame 14 so that trailer frame 14 may be parked or positioned at an inclined support surface 52 while maintaining base frame 12 in a level or horizontal orientation. The orientation of base frame 12 is adjustable via an actuator 54 connected between trailer frame 14 and base frame 12. For example, actuator 54 may be a double-acting hydraulic cylinder having a first end 54*a* pivotally mounted at trailer frame 14, and a second end 54*b* pivotally mounted at a first link 56. First link 56 is pivotally connected at a first end 56*a* to a location on trailer frame 14 spaced from first end 54*a* of actuator 54 and is pivotally mounted at a second end 56*b* to a first end 58*a* of a second link 58. Second link 58 has a second end 58*b* pivotally connected to base frame 12. Optionally, the various components of the mixing plant may be mounted to an articulating skid, such as a steel plate, that pivots relative to the base frame and/or the trailer frame.

Thus, by extension and retraction of actuator 54, a front end 12*a* of base frame 12 is urged upwardly until base frame 12 is substantially level. Referring to FIG. 2, an angle θ is thereby formed between base frame 12 and trailer frame 14. Angle θ may range anywhere from zero degrees to thirty degrees or more, thus enabling mixing plant 10 to be positioned on a substantially sloped support surface 52 without affecting the operation of mixing plant 10.

As best seen in FIGS. 1 and 2, trailer frame 14 may be equipped with one or more jack stands or outriggers 60 that are laterally and vertically extendable to support trailer frame 14 opposite one or more wheels 62 at the rear end of trailer frame 14. Trailer frame 14 may be part of a conventional pup-style trailer and include a steel frame and wood deck, for example. Alternatively, or additionally, mixing plant 10 may be supported by a rail car, a floating barge, or other vehicle or support.

Accordingly, transportable concrete mixing plant 10 provides a substantially self-contained concrete mixing and dispensing facility that is readily transported to a convenient location, which may have a sloped or non-level surface, and is operable to supply a substantially constant flow of mixed, uncured, flowable concrete to a location spaced from mixing plant 10. Transportable concrete mixing plant 10 is first moved, typically via road, such as by connecting trailer frame 14 to a tow vehicle such as a semi-tractor. Mixing plant 10 is positioned on support surface 52 and supported in place by outriggers 60 and wheels 62, after which the tow vehicle may be detached. If support surface 52 is sloped at angle θ, mixing plant 10 is typically oriented with its rear end and loading location 38 positioned at the higher elevation. In this manner, actuator 54 may be extended to pivot base frame 12 counterclockwise as viewed in FIG. 2, relative to trailer frame 14, at angle θ so that base frame 12 is supported in a substantially level, horizontal orientation. Optionally, the base frame may be hinged to the trailer frame at their front ends so that the mixing plant may be oriented with its front end positioned at the higher elevation.

Containers 36 are positioned at loading location 38 behind base frame 12 and below a rear end portion 30*b* of overhead rail 30. Cable 46 is lowered from carriage assembly 34 and attached to lift straps 48 of container 36, after which cable 46 is drawn upwardly into carriage assembly 34, such as with winch 35, until bottom opening 50 of container 36 is raised above the level of supply chutes 32*a*, 32*b*. Carriage assembly 34 is then urged forwardly, either manually or with a powered actuator (such as a conventional electric trolley drive unit), along overhead rail 30 until it reaches a front portion 30*a* of rail 30 so that bottom opening 50 is positioned directly above supply chutes 32*a*, 32*b*. Bottom opening 50 is then opened to release dry premix concrete from container 36 into one or both of supply chutes 32*a*, 32*b*. Dry premix concrete flows through bottom opening 50 of container 36 and slides or flows down into one of mixing drums 18*a*, 18*b* via corresponding supply chute 32*a*, 32*b*. Once empty, container 36 is removed from carriage assembly 34, which is urged backward along overhead rail 30 toward rear portion 30*b* in order to receive the next container. Containers 36 may be discarded or reused once they have been emptied.

Mixing drum 18*a* or 18*b* receives water from water tank 26 and proceeds to rotate about its longitudinal axis until the water and premix are sufficiently mixed to form flowable or liquid concrete, after which the mixing drum is tilted or pivoted downwardly (and its direction of rotation may be reversed) to dispense the mixed flowable concrete into funnel 44, which channels the flowable concrete into receiving hopper 42. Once the mixing drum is emptied, it is pivoted upwardly to receive the next batch of dry premix concrete and water.

Mixed, uncured, flowable concrete in receiving hopper 42 is directed into concrete pump 20, which pumps the flowable concrete away from mixing plant 10 and into a waiting transport vehicle or to the point of use. By providing a steady supply of containers 36 containing dry premix concrete, fuel, and water, concrete mixing pump 10 may be operated substantially continuously to provide a substantially constant flow of flowable concrete at a work site.

Optionally, control panel 64 may be provided at mixing plant 10 for controlling various operations such as, for example, positioning outriggers 60, extending and retracting actuator 54, extending and retracting cable 46, moving carriage assembly 34 along overhead rail 30, controlling the tilt and rotation of mixing drums 18*a*, 18*b*, controlling concrete pump 20, controlling the water pump, controlling the electrical generator 22, and controlling lights for operations in darkness. Control panel 64 includes a controller, such as a microprocessor board controller, which is in communication with the various components on the mixing plant, Optionally, the controller permits substantially automated operation of mixing plant 10. However, it will be appreciated that plant 10 may be controlled by an operator via control panel 64, or may be fully manually operated, without departing from the spirit and scope of the present invention.

Optionally, and with reference to FIGS. 4-8 and 11, another transportable concrete mixing plant 110 includes a wheeled transport frame or trailer frame 114, a forward drum-supporting superstructure 116*a*, and a rearward hopper-supporting superstructure 116*b*. Like plant 10, described above, transportable concrete mixing plant 110 provides a substantially self-contained concrete mixing and dispensing facility that is readily transported, such as by road, to a location near a worksite. Many components of mixing plant 110 are the same as (or may be similar to) corresponding components of plant 10, but it will be appreciated that mixing plant 110 has a different apparatus for elevating premix concrete into a position where it can be dispensed into the mixing drums.

Transport frame 114 of mixing plant 110 supports a pair of pivotable mixing drums 118*a*, 118*b*, a concrete pump or auger 120 that is fed by a large rectangular hopper 121 capable of receiving mixed flowable concrete from both mixing drums 118*a*, 118*b*, an electrical generator 122, a hydraulic power unit 124, a water tank 126, and a fuel tank 128, all of which are generally similar to corresponding drums 18*a*, 18*b*, pump 20, generator 22, hydraulic power unit 24, water tank 26, and fuel tank 28 of mixing plant 10, such that these components and their operation may be readily understood with reference to the above discussion. Concrete auger 120 is operable to move wet flowable concrete from hopper 121 off of mixing plant 110, such as into a separate concrete pump, a cement bucket (such as a bucket that is lifted by a crane or supported on a wheeled cart), a pump truck or pump trailer, or substantially any other suitable receptacle for moving the wet flowable concrete to a desired location.

Transport frame 114 is selectively supportable by a set of adjustable jackstands 112 that can be lowered into contact with a support surface S on which the mixing plant 110 rests.

Jackstands 112 are height-adjustable to allow leveling of the transport frame 114 on sloped or uneven surfaces. Optionally, the mixing plant 110 may be equipped with a pivotable base frame, similar to base frame 12 of mixing plant 10, which supports the mixing drums, concrete pump, and other components of the plant to facilitate use of the mixing plant 110 on a sloped or non-level surface.

Figure 4:
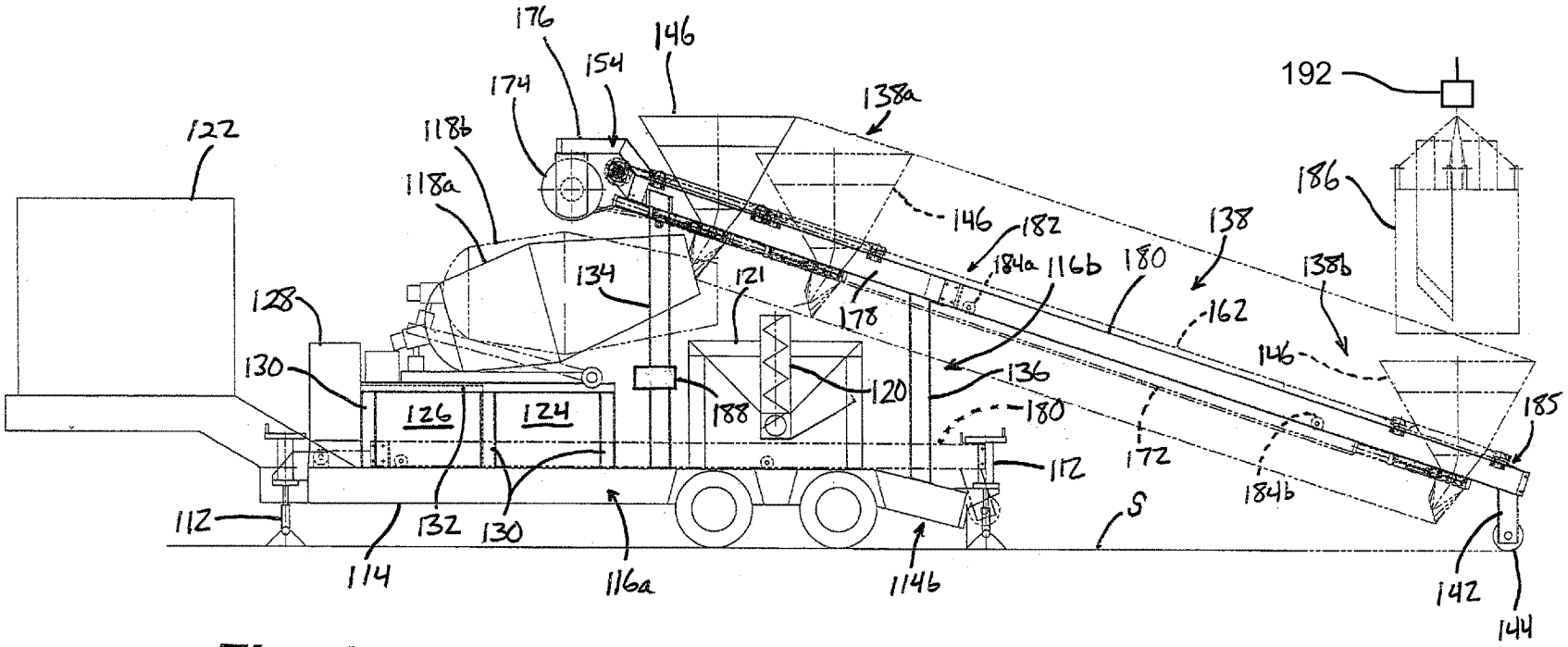
FIG. 4 is a side elevation of another transportable concrete mixing plant in accordance with the present invention.
Figure 5:
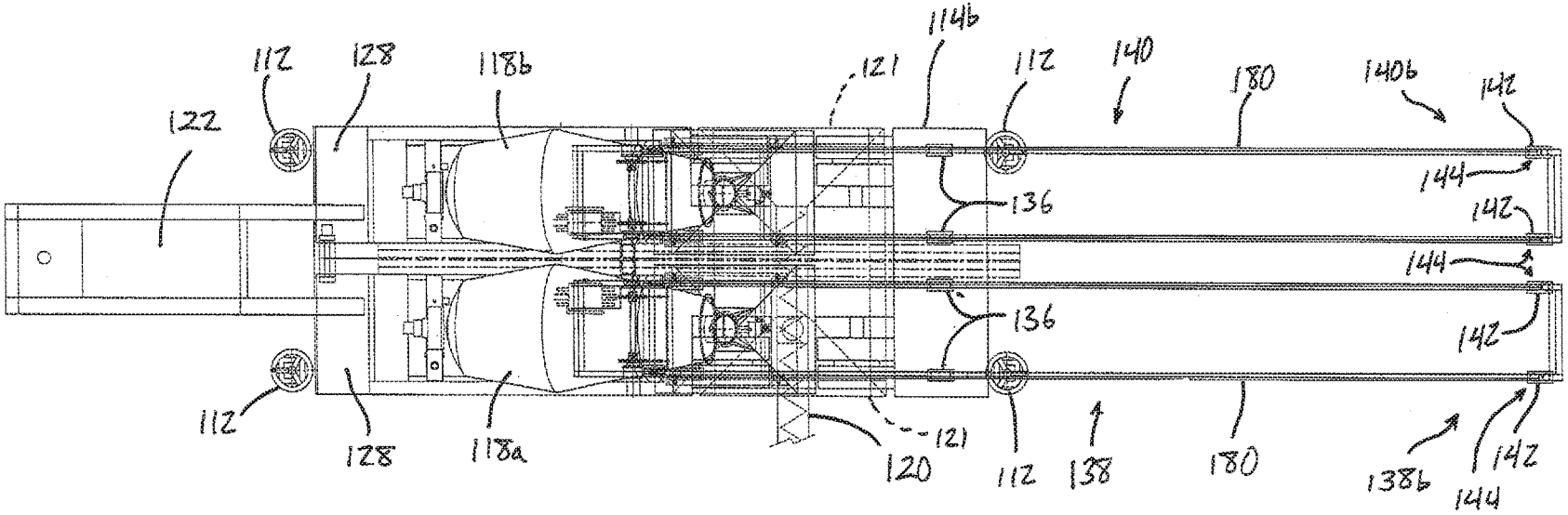
FIG. 5 is a top plan view of the transportable concrete mixing plant of FIG. 4.
Figure 7:
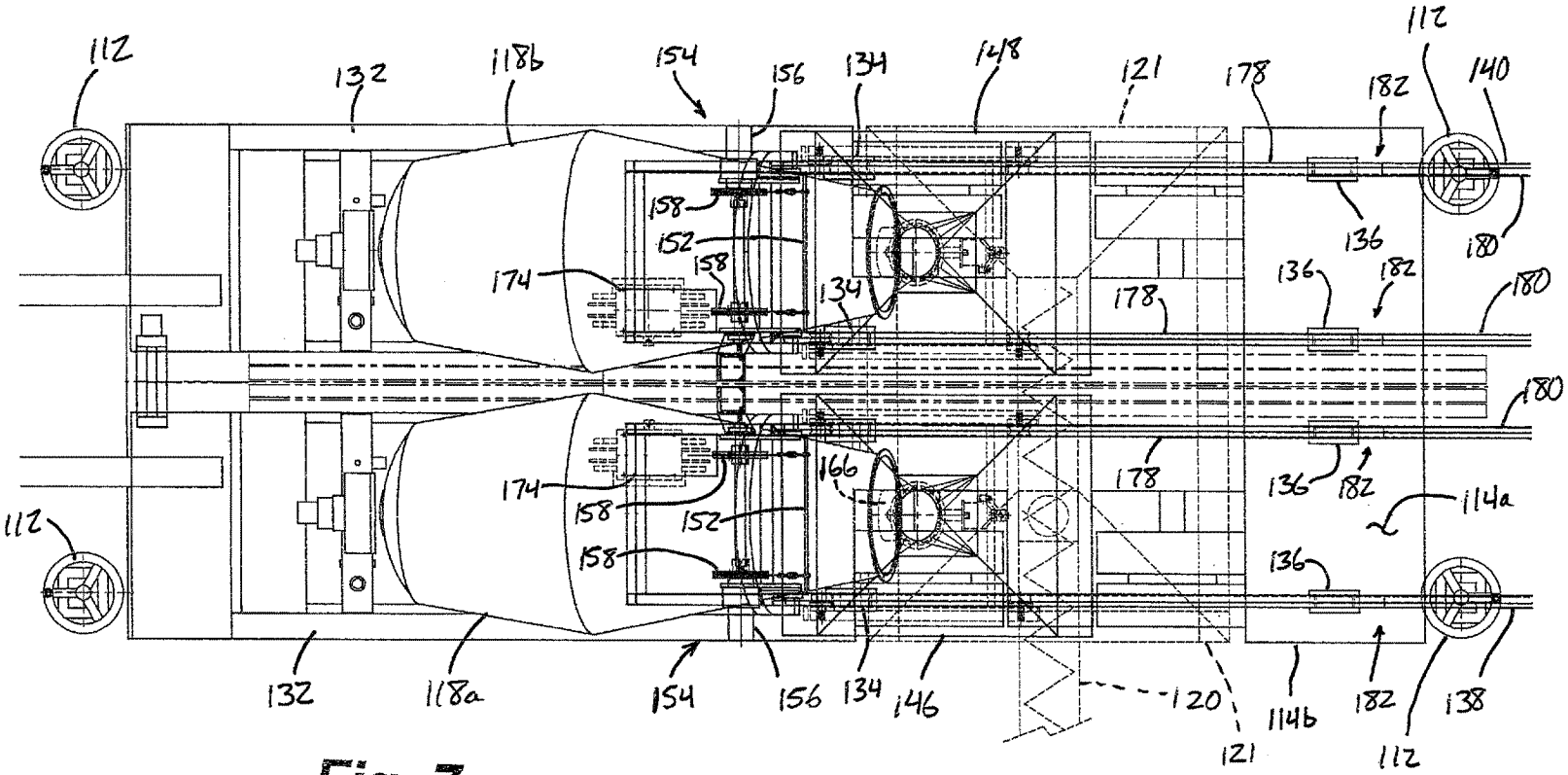
FIG. 7 is an enlarged view of the area designated VII in FIG. 5.

The forward drum-supporting superstructure 116*a* of mixing plant 110 includes a plurality of vertical support beams 130 supporting horizontal support beams 132 that form a respective support platform for each mixing drum 118*a*, 118*b*. Rearward hopper-supporting superstructure 116*b* includes left and right pairs of forward vertical support beams 134, and left and right pairs of rearward vertical support beams 136. The left pairs of vertical support beams 134, 136 cooperate to support a left support track 138 at its forward or dispensing end portion 138*a*, and the right pairs of vertical support beams 134, 136 cooperate to support a right support track 140 at its forward end portion 140*a*. Each support track 138, 140 has a respective rearward or loading end portion 138*b*, 140*b* that, when mixing plant 110 is set up in its operational configuration of FIG. 4, are spaced laterally away from the aft or rearward end of transport frame 114 and are supported along the ground or other support surface by a respective support legs 142. Bach support leg 142 has a ground-engaging wheel 144 at its lower end to facilitate small movements of support tracks 138, 140 relative to transport frame 114 during operation of mixing plant 110. Wheels 144 also facilitate set-up and take-down of mixing plant 110, during which it may be desirable to movably support rearward end portions 138*b*, 140*b* of support tracks 138, 140 along the ground, as will be described below. As best shown in FIGS. 5 and 7, each support track 138, 140 may be made up of a pair of laterally-spaced rails or beams (such as I-beams) that are supported by respective support legs 142 and wheels 144 (FIG. 5) at their rearward end portions 138*b*, 140*b*, and that are supported by respective vertical support beams 134, 136 at their forward end portions 138*a*, 140*a*.

A left movable supply hopper 146 is supported by left support track 138, and a right movable supply hopper 148 (substantially identical to left supply hopper 146) is supported by right support track 140. While the following description is directed primarily to left supply hopper 146 on left support track 138, and left mixing drum 118*a*, it will be understood that the same principles apply to right supply hopper 148 on right support track 140, and right mixing drum 118*b*. Left supply hopper 146 is movable along left support track 138 between a lower position (shown in dashed lines in FIG. 1) at rearward end portion 138*b* of track 138, and a raised position (in solid lines) at forward end portion 138*a* of track 138. Supply hopper 146 includes an upper end portion 146*a*, and a lower end portion 146*b*. Supply hopper 146 is generally funnel-shaped, with upper end portion 146*a* defining an open mouth having generally larger dimensions than lower end portion 138*b* of funnel 138. Lower end portion 146*b* of supply hopper 146 is narrower than upper end portion 146*a*, and includes a dispensing portion 148 with a movable slide-gate or the like, for selectively dispensing bulk materials, such as dry premix concrete, from supply hopper 146, as will be described below.

Figure 6:
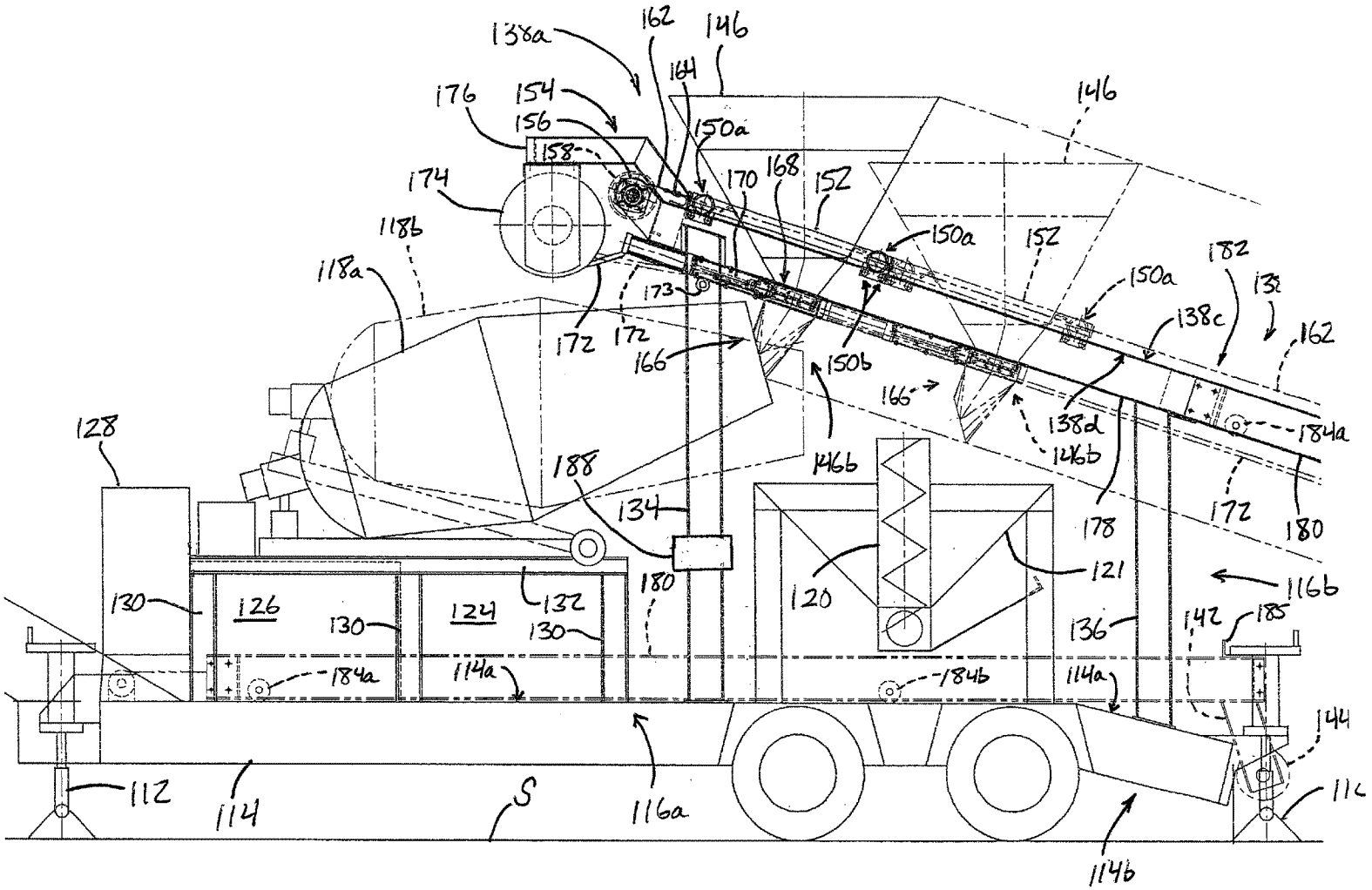
FIG. 6 is an enlarged view of the area designated VI in FIG. 4.

Supply hopper 146 is movably supported on left support track 138 via a plurality of wheels including upper wheels 150*a* and lower wheels 150*b*, which are rotatably coupled to a carriage 152 at lower end portion 146*b* of supply hopper 146 (FIG. 6). Upper wheels 150*a* roll along an upper track surface 138*c* of left support track 138, while lower wheels 150*b* roll along a lower track surface 138*d*. Optionally, lower wheels 150*b* are spaced slightly from lower track surface 138*d*, and only contact the lower track surface 138*d* if a force is applied to supply hopper 146 that would tend to lift the supply hopper away from left support track 138, such as due to a strong wind, abrupt acceleration or deceleration, or the like.

Figure 8:
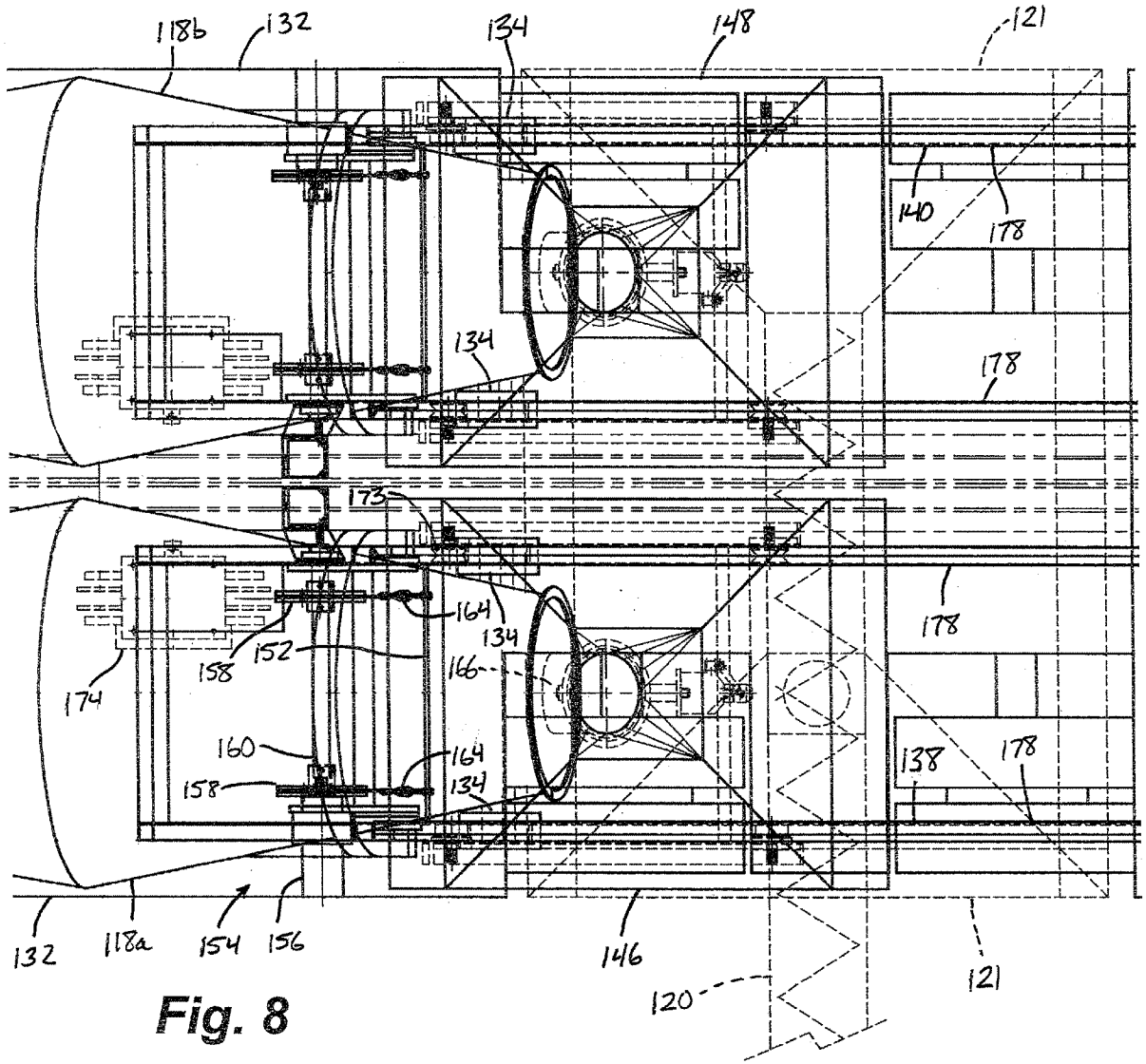
FIG. 8 is an enlarged view of the area designated VIII in FIG. 7.

Mounted at forward end portion 138*a* of left support track 138 is a drive system 154 in the form of a motorized cable winch (FIGS. 4-8). Drive system 154 includes a motor 156, such as an electric, hydraulic, or pneumatic motor, and a pair of cable drive pulleys or spools 158 mounted to a drive shaft 160 for winding and unwinding cables 162 that extend along left support track 138 (FIGS. 6 and 7). Cables 162 are coupled to supply hopper 146 at carriage 152 via respective shackles 164, as best shown in FIG. 8. Motor 156 rotates drive shaft 160 to rotate pulleys 158, which causes cables 162 to be wound onto the respective pulleys 158. This draws supply hopper 146 upwardly along left support track 138, toward upper end portion 138*a*. When supply hopper 146 is to be moved back down to lower end portion 138*b* of left support track 138, motor 156 rotates shaft 160 and pulleys 158 in the opposite direction to unwind cables 162 from their respective pulleys, thus allowing gravity to move supply hopper 146 back down along left support track 138, while motor 156 is used to limit the speed of supply hopper 146, until the supply hopper reaches lower portion 138*b*. Optionally, a stop member 185 (FIGS. 4 and 6) is provided at rearward end portion 138*b* of support track 138 to engage carriage 152 and limit or prevent movement of supply hopper 146 during loading. Stop member 185 also provides a safety stop so that supply hopper 146 cannot run off the rearward end of support track 138 if drive system 154 were to malfunction by paying out an excessive amount of cable 162, or if the cables were to break, for example.

Supply hopper 146 includes a spout or dispensing portion 166 at its lower end portion 146*b*. Dispensing portion 166 includes a movable slide gate 168 that is actuatable via a double-acting cylinder or linear actuator 170 (FIG. 6), such as a pneumatically or hydraulically actuated cylinder, which operates in response to pressurized fluid (e.g. air or hydraulic fluid) to open and close the slide gate 168 so that bulk material can be selectively dispensed through dispensing portion 166. Actuator 170 may be supplied with pressurized fluid via a flexible hose or conduit 172 that is selectively wound and unwound from a hose reel 174 (FIGS. 4-8). Hose reel 174 is rotatably mounted to a frame member 176 coupled to forward end portion 138*a* of left support track 138, which also supports drive system 154. Hose reel 174 may incorporate a spring return mechanism so that hose reel 174 always applies tension to hose 172, and so that hose 172 winds and unwinds on hose reel 174 with the actuation of drive system 154 to move supply hopper 146 between its lowered and raised positions. A guide pulley or sheave 173 (FIG. 6) is rotatably mounted to forward vertical support beam 134 for supporting and maintaining proper alignment or positioning of hose 172 as the hose is paid out and drawn in below left support track 138 with the respective lowering and raising of left supply hopper. Optionally, hose reel 174 may incorporate a motorized drive system that can rotate the hose reel in opposite directions, to wind and unwind hose 172, simultaneously with the actuation of drive system 154. Thus, hose 172 may be coupled between the actuator 170 at the dispensing portion 166 of supply hopper 146 and a pressurized fluid source (such as hydraulic power unit 124) so that slide gate 168 may be actuated when supply hopper 146 is at the raised position corresponding to forward end portion 138*a* of left support track 138.

Forward end portion 138*a* of left support track 138 is positioned near the open mouth of left mixing drum 118*a* so that dispensing portion 166 of left supply hopper 146 is positioned at or near the open mouth of left mixing drum 118*a* when the supply hopper 146 and mixing drum 118*a* are both at their respective raised positions (FIGS. 4 and 6-8). With left supply hopper 146 at its forward position, dispensing portion 166 is aligned with the open mouth of left mixing drum 118*a* so that bulk materials dispensed through the dispensing portion pass directly into the left mixing drum 118*a*.

Thus, supply hopper 146 may be filled with bulk dry premix concrete (or other bulk material) at rearward portion 138*b* of left support track 138, then moved to forward portion 138*a* of left support track 138 for selectively dispensing the bulk material into left mixing drum 118*a*, as controlled by slide gate 168 and actuator 170 at dispensing portion 166 of the left supply hopper 146. Supply hopper 146 may then be lowered for reloading via a bulk material bag or container 186 (FIG. 4) that is positionable above supply hopper 146 at the supply hopper's lowered position. For example, such bags or containers are described in co-pending U.S. patent application Ser. No. 13/599,036, filed Aug. 30, 2012 for "MULTI-CHAMBER CONTAINER FOR BULK MATERIALS," now U.S. Pat. No. 9,045,274, which is hereby incorporated herein by reference in its entirety.

In the illustrated embodiment, and as best shown in FIGS. 4 and 6, left support track 138 includes a fixed forward track portion 178 (at least a part of which defines forward end portion 138*a*) and a separable rearward track portion 180 (at least a part of which defines rearward end portion 138*b*). Fixed forward track portion 178 is supported on vertical support beams 134, 136 of rearward superstructure frame 116*b*, while the separable rearward portion is supportable alternately by fixed forward track portion 178 and support leg 142, or along transport frame 114. When mixing plant 110 is to be readied for use, separable rearward track portion 180 is joined at its forward end to the rearward end of fixed forward track portion 178 at a joint 182. Joint 182 may include mechanical fasteners or the like, and is located just rearward of where vertical support beam 136 is coupled to fixed forward track portion 178 of left support track 138. The rearward end of separable rearward track portion 180 is supported by support leg 142 and wheel 144.

Figure 11:
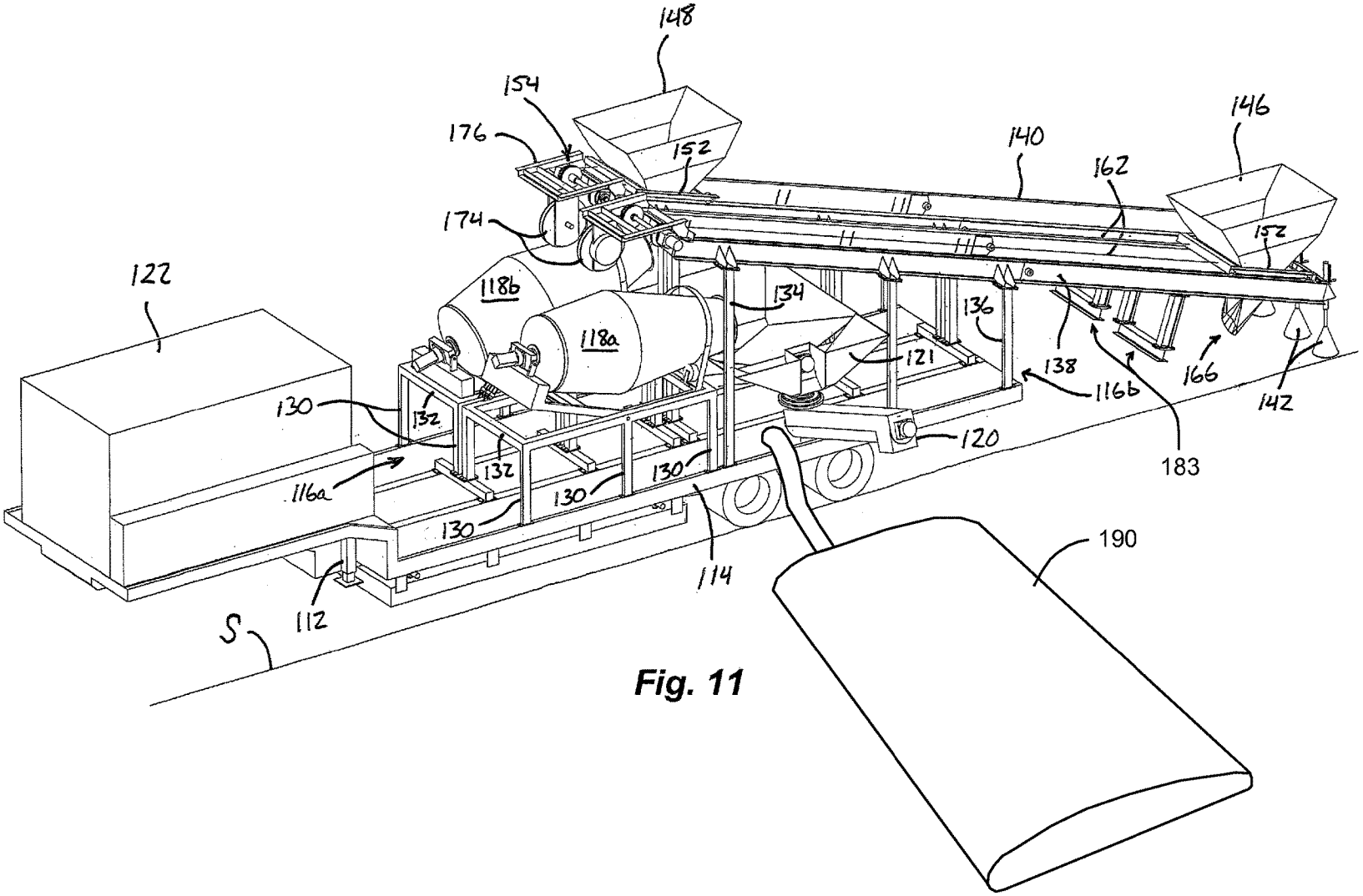
FIG. 11 is a perspective view of a transportable concrete mixing plant that is substantially similar to the mixing plant of FIG. 4.

Optionally, and as shown in FIG. 11, additional extendable and retractable forward support legs 183 may be attached forwardly of support legs 142 and extended (lowered) into contact with support surface S during operation of mixing plant 110 to provide extra mid-span support for support tracks 138, 140 when loaded supply hoppers 146, 148 are traversing the respective tracks. Forward support legs 183 may also be used to hold the support tracks 138, 140 above the support surface S when they are not connected to fixed forward track portion 178, and to aid in aligning the support tracks 128, 140 with forward track portion 178 during setup of mixing plant 110.

When mixing plant 110 is to be readied for transport, separable rearward track portion 180 is decoupled from fixed forward track portion 178 at joint 182, and separable rearward track portion 180 is then moved into a stowed position (shown in dashed lines in FIGS. 4 and 6) so that the separable rearward track portion 180 is supported along a top surface 114*a* of transport frame 114, between respective vertical support beams 130, 134, and 136 of forward and rearward superstructure frames 116*a*, 116*b*, Separable rearward track portion 180 may be secured to transport frame 114 in its stowed position using latches, tie-down straps or chains, clamps, or the like. Left supply hopper 146 may be stowed along fixed forward track portion 178 of left support track 138 during transport of the mixing plant 110, and cables 162 may be left attached to carriage 152.

A set of forward and rearward rollers or wheels 184*a*, 184*b* are provided along a lower surface of separable rearward track portion 180 to facilitate moving separable rearward track portion 180 of left support track 138 along the top surface 114*a* of transport frame 114 for stowage. As best shown in FIG. 6, rollers 184*a*, 184*b* extend slightly below the lower surface of separable rearward track portion 180 so that track portion 180 is rollingly supported along upper surface 114*a* when in the stowed position, or when being moved to the stowed position or out of the stowed position. Optionally, additional rollers may be provided to facilitate rolling the separable rearward track portion along transport frame 114.

Thus, rollers 184*a*, 184*b* and wheels 144 aid in the setup and take-down of mixing station 110 by allowing separable rearward track portion 180 to be rolled along upper surface 114*a* of transport frame 114 and the support surface S. For example, in the illustrated embodiment, transport frame 114 has a sloped or angled rearward portion 114*b*, to which rearward vertical support beams 136 are coupled, which can support the forward end of separable rearward track portion 180 at the forward roller 184*a*. To reposition separable rearward track portion 180 from its in-use position (i.e. coupled to fixed forward track portion 178) to its stowed position, rearward track portion 180 is decoupled at joint 182 and the forward end of rearward track portion 180 (which includes forward roller 184*a* and part of joint 182) is lowered to the sloped rearward portion 114*b* of transport frame 114 so that forward roller 184*a* rests on top surface 114*a* of transport frame 114 at angled rearward portion 114*b*. Wheel 144 is permitted to roll along support surface S as necessary during movement of rearward track portion 180.

Once forward roller 184*a* is supported at angled rearward portion 114*b*, rearward track portion 180 may be pushed or urged forwardly, causing forward roller 184*a* and then rearward roller 184*b* to roll along and support rearward track portion 180 on top surface 114*a* of transport frame 114. Once the center of gravity of rearward track portion 180 is positioned directly above a portion of transport frame 114, rearward track portion 180 will tend to pivot and lift wheel 144 off of support surface S so that the entire weight of rearward track portion 180 is supported at transport frame 114, such as shown in dashed lines in FIGS. 4 and 6. Once rearward track portion 180 is in its stowed position, it can be secured to transport frame 114 to prevent movement of the track portion during movement of the mixing plant 110. To move rearward track portion 180 to its in-use position, the above steps may be completed in reverse order. Optionally, a winch or similar device may be provided at or near rearward vertical support beam 136, and/or at a forward end of transport frame 114, and configured for moving rearward track portion 180 between its in-use and stowed positions.

As noted above, right supply hopper 148, right support track 140, and their associated components may be substantially identical to left supply hopper 146, right support track 138, and their associated components, such that the components and operation of the right side of mixing plant 110 may be fully understood with reference to the above description pertaining to the left side of mixing plant 110. In the overhead views of FIGS. 7 and 8, components along the right side of mixing plant 110 (i.e. corresponding to right mixing drum 118*b*, right support track 140, and right movable supply hopper 148) are shown with identical reference numerals as identical components shown along the left side of the mixing plant. Thus, it will be appreciated that the right side of mixing plant 110 includes a carriage 152 (supporting right movable supply hopper 148), a drive system 154 including a motor 156, pulleys 158, drive shaft 160, cables 162, and shackles 164, and a fluid hose or conduit 172 wound on a hose reel 174, all of which are operable in an identical manner to like components along the left side of the mixing plant.

In addition, right support track 140 is made up of a fixed forward track portion 178 and a separable rearward track portion 180, which are separably joined at a joint 182, so that the separable rearward track portion 180 of right support track 140 is stowable in the same manner as that of left support track 140. Optionally, the separable rearward track portions 180 of left and right support tracks 138, 140 may be fully interchangeable, as may the other components for which duplicates are provided on either side of the mixing plant. Thus, the mixing plant can generally be operated on at least one side, even when one or more components on one or the other side are in need of service or replacement. It is further envisioned that in the event that only the left or right supply hopper is operable for a period of time (e.g. the other supply hopper or a related component is down for service), the operating supply hopper can be used to alternately supply bulk materials to each mixing drum 118*a*, 118*b*, similar to the manner in which a single overhead conveyor can supply bulk materials to either of two mixing drums on mixing plant 10 via a pair of supply chutes that are fed from a common supply hopper and controlled by a discharge actuator, so that mixing plant 110 can still operate at full (or nearly full) capacity, with a constant or nearly-constant supply of mixed flowable concrete still being produced in the mixing drums.

Optionally, and as shown in FIG. 11, a water bladder tank 190 may be provided to allow for increased water capacity for mixing plant 110 without need for additional on-board water storage. Water bladder tank 190 can store hundreds, thousands, or tens of thousands of gallons of water for use in mixing concrete on-site, and can be readily drained and stored compactly on the mixing station when not in use. Suitable water bladder tanks are available, for example, from Husky Portable Containment of Dewey, Okla., and Interstate Products, Inc. of Sarasota, Fla.

In operation, each supply hopper 146, 148 is moved to its rearward position at the respective rearward end portion 138*b*, 140*b* of support track 138, 140, and filled with dry premix cement materials, preferably from multi-chamber bag or container 186 (FIG. 4). Motor 156 of drive system 154 is then energized to draw its respective supply hopper 146, 148 upwardly by winding cables 162 onto pulleys 158, until the supply hopper 146, 148 is positioned at the forward end 138*a*, 140*a* of the respective support track 138, 140. When the respective mixing drum 118*a*, 118*b* is sufficiently empty and ready to receive a load of dry premix concrete from the supply hopper 146, 148, the movable slide gate 168 of the hopper 146, 148 is opened to release the hopper's contents into the drum 118*a*, 118*b*. With hopper 146, 148 empty, drive system 154 is again activated to lower the hopper back down to the rearward end 138*b*, 140*b* of its support track, its slide gate is closed, and the contents of another bag or container 186 may be dispensed into the hopper. In all other respects, the operation of mixing plant 110 may be substantially identical to that of mixing plant 10, such that the other operational aspects of mixing plant 110 may be fully understood with reference to the above description of mixing plant 10.

Mixing plant 110 may be operated manually or, similar to mixing plant 10, may be partially or substantially fully automated via a control panel 188 (FIGS. 4 and 6). In the illustrated embodiment, control panel 188 is mounted at one of vertical support beams 134, although it will be appreciated that it could instead be mounted, substantially anywhere along the mixing plant 110, including at the rearward end portion 138*b*, 140*b* of the left or right support track 138, 140, for convenience access by one or more operators. Control panel 188 may control the various operations carried out by the mixing plant 110, such as activating the drive systems 154 to move the supply hoppers 146, 148 between their forward and rearward positions, operating actuators 170 and movable slide gates 168 at the respective supply hoppers, operating the mixing drums 118*a*, 118*b* and concrete auger 120, and operating the other mixing plant components such as the electrical generator 122, hydraulic power unit 124, water tank 126 and its associated pump, jackstands 112 for auto-leveling (e.g. if the jackstands are powered by power unit 124), optional lights, etc. Control panel 188 includes a controller, such as a microprocessor board controller, which is in communication with the various components on the mixing plant 110. The controller may permit substantially automated operation of mixing plant 110 so that once the plant is set up in its operating configuration, an operator may be stationed near rearward end portions 138*b*, 140*b* of the support tracks 140 for loading the contents of bags 186 into the respective supply hoppers 146, 148 using a crane, a bag conveyor, a front-end loader, or the like.

Optionally, the controller associated with control panel 188 may receive information specific to the premix that is contained in each bag 186 or other container being dispensed into supply hoppers 146, 148. For example, each bag 186 may include a label having a computer-readable barcode, RFID chip, or the like, which lists the filled bag's original weight at the time of its filling, as well as the bag's individual contents (e.g. cement binder, aggregate, and sand) by weight, volume, or ratio. This information may be generated at the time of the bag or container's filling, such as in a manner described in co-pending U.S. patent application Ser. No. 13/599,024, filed Aug. 30, 2012 for "APPARATUS AND METHOD FOR FILLING MULTI-CHAMBER CONTAINERS WITH BULK MATERIALS," now U.S. Pat. No. 9,010,382, which is hereby incorporated herein by reference in its entirety. The bag 186 may be re-weighed at the mixing plant 110 by a legal-for-trade weigh scale 192 (FIG. 4) associated with a crane or other lifting apparatus, or by a separate measurement scale that supports the bag, prior to dispensing the bag's contents into one of supply hoppers 146, 148, or the contents of the bag may be weighed in the supply hopper via load cells or the like (in which case the weight of the empty bag would not be included in the measurement).

Optionally, the controller compares the current bag weight, measured at mixing plant 110, to the original bag weight indicated on the bag's label, and assumes that any increase in the bag's weight by the time it reaches mixing plant 100 is due to water that has entered the bag's contents. This additional water could be due to rainfall or other water sources that have come into contact with bag 186 since it was originally filled and weighed. The controller can then reduce the amount of water added to the mixing drum that receives the premix contents of the weighed bag 186, to account for the moisture that is present in the premix. For example, if a given bag 186 is weighed just prior to dispensing its contents into a supply hopper 146 or 148, and the bag is found to weigh about eight pounds more than it did when it was filled, the controller will calculate the amount of water that should normally be added to the amount of dry premix that was initially measured in the bag at the time of its filling, and will subtract one gallon (eight pounds) of water from that amount, for addition to the mixing drum. In this way, the amount of water that is mixed with the premix can be precisely tailored by factoring in any moisture that has been added to the bag since the time it was filled. This also has the benefit of permitting storage of bags containing premix in places where they can be exposed to moisture, substantially without adversely affecting the performance or material properties of the mixed or hardened concrete.

Figure 9:
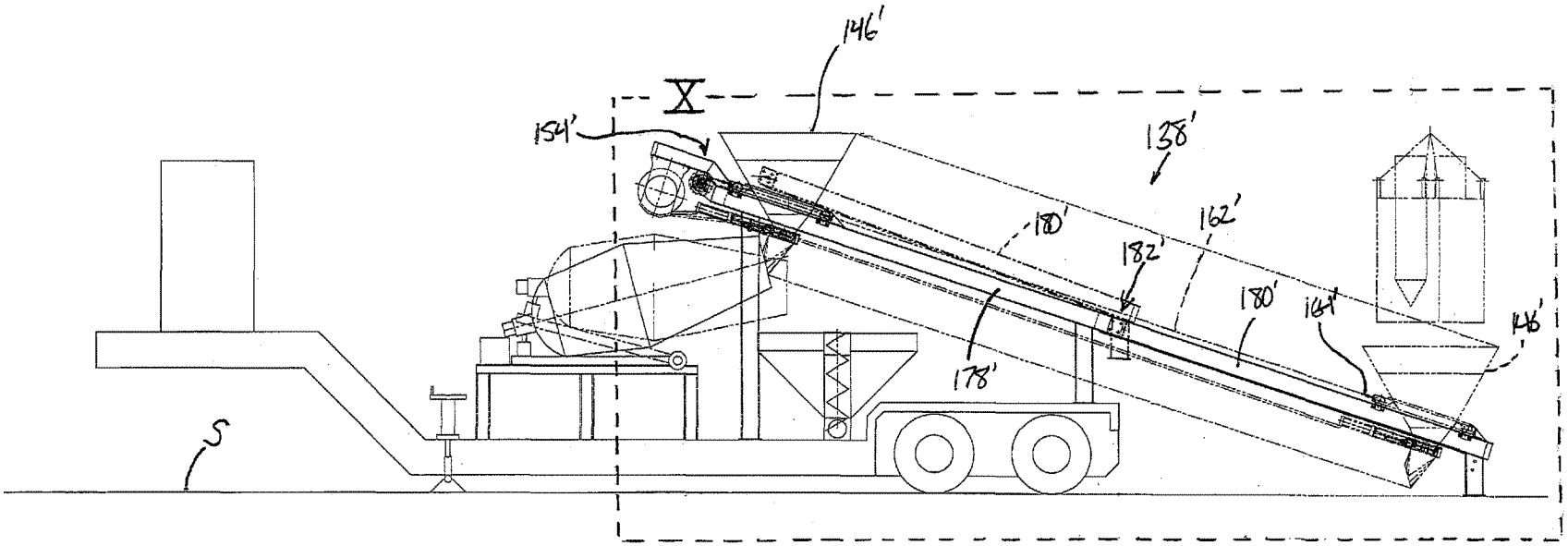
FIG. 9 is a side elevation of another transportable concrete mixing plant in accordance with the present invention.
Figure 10:
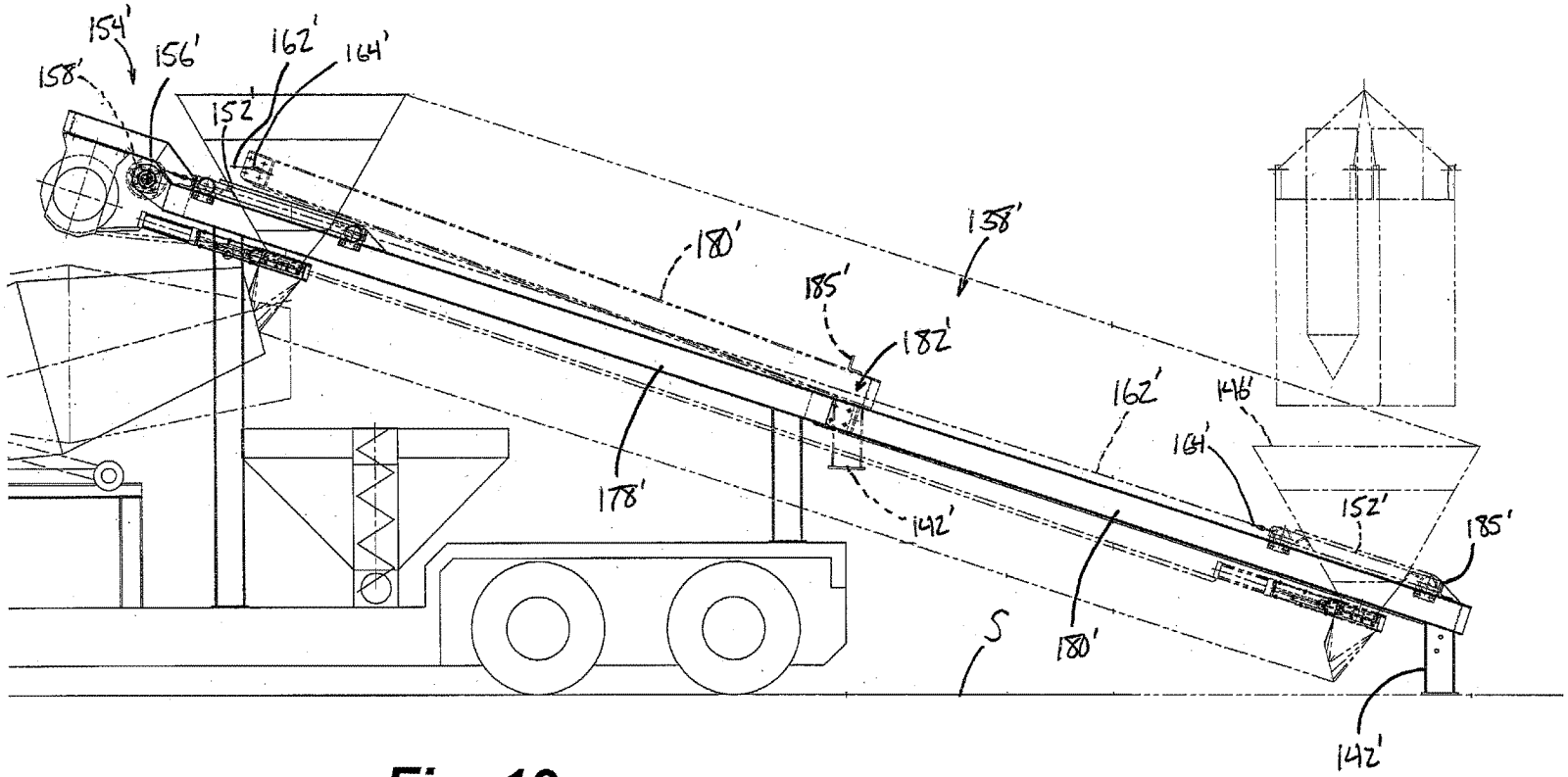
FIG. 10 is an enlarged view of the area designated X in FIG. 9.

Optionally, and with reference to FIGS. 9 and 10, another transportable concrete mixing plant 110', which is substantially similar to mixing plant 110, includes left and right support tracks (left support track 138', shown) having fixed forward track portions 178' and separable rearward track portions 180' for supporting respective movable supply hoppers (left supply hopper 146', shown). Fixed forward track portion 178' is substantially identical to fixed forward track portion 178 of mixing plant 110. Separable rearward track portion 180' is also substantially identical to separable rearward track portion 180 of mixing plant 110, except that separable rearward track portion 180' is configured to be positioned atop fixed forward track portion 178' when the separable rearward track portion 180' is stowed for transport of the mixing plant 110', such as shown in dashed lines in FIGS. 9 and 10.

In order to position separable rearward track portion 180' atop fixed forward track portion 178', the track portions are detached from one another at junction 182' and cables 162' may be attached to the forward end of separable rearward track portion 180' via shackles 164'. This allows drive system 154' to be used to draw the separable rearward track portion 180' forwardly along fixed forward track portion 178', such as by first detaching the cables 162' from the shackles connected to carriage 152' (or detaching the shackles from carriage 152' and attaching them to rearward track portion 180') and then energizing the motor 156' to wind cables 162' onto pulleys 158'. In its stowed position, separable rearward track portion 180' is positioned with its individual beams on either side of movable supply hopper 146', and resting atop carriage 152'.

A support leg 142', at the rearward end of separable rearward track portion 180', rests on the support surface S when mixing plant 110' is readied for use. Support leg 142' is positioned adjacent the rearward end of fixed forward track portion 178' when separable rearward track portion 180' is moved to its stowed position. It will be appreciated that support leg 142' may be equipped with a wheel, much like wheel 144 of support leg 142, described above, to aid in moving the separable rearward track portion 180' between its stowed and in-use positions. Separable rearward track portion 180' may be re-deployed to its in-use position by allowing drive system to pay out cable 162' in a controlled manner until the rearward track portion 180' can be realigned and rejoined to forward track portion 178' at joint 182'. A stop member 185' provides substantially the same function as stop member 185 of mixing plant 110, described above.

Thus, the stowing configuration of separable rearward track portion 180', and the ability to use drive system 154' in the stowage and deployment of the rearward track portion, allow separable rearward track portion 180' to be stowed and deployed more quickly and easily, and in fewer steps, than the method of stowing and deploying rearward track portion 180 of mixing plant 110. In all other respects, mixing plant 110' may be substantially similar to mixing plant 110, such that its components and operation may be fully understood with reference to the descriptions above.

Accordingly, the present invention provides a mobile concrete mixing plant that can be transported to substantially any desired location, including off-road and/or remote locations, for use in preparing a substantially constant supply of consistent-quality mixed wet concrete for construction projects. Because the mixing plant is substantially self-contained and configured to use bags or other containers of dry premix concrete (rather than separate supplies of cement, sand, and aggregate, for example) to supply its two mixers, and may be equipped with a controller that can compensate for moisture contamination of the premix, the mixing plant can be operated in relatively small clearings or open spaces, and can operate substantially continuously as long as sufficient fuel and premix concrete is provided to the plant. The plant includes a pair of mixing drums and a pair of supply hoppers that convey premix to the drums, so that the plant can produce mixed wet concrete substantially continuously, even if one drum or supply hopper is not in operation, and the plant can readily be leveled as needed for operation on sloped or non-level support surfaces.

Changes and modifications in these specifically described embodiments may be carried out without departing from the principles of the present invention, which is intended to be limited only by the scope of the appended claims, as interpreted according to the principles of patent law including the doctrine of equivalents.

The embodiments of the invention in which an exclusive property or privilege is claimed are defined as follows:

1. A transportable concrete mixing apparatus comprising:

a transport frame that is supportable on a ground surface;

a mixing drum coupled to said transport frame;

a movable supply hopper configured to receive premix concrete, said movable supply hopper having an upper end portion and a lower dispensing portion that is operable to selectively dispense the premix concrete from said supply hopper;

a support track for movably supporting said supply hopper, said support track having a loading end portion spaced laterally away from said transport frame, and a dispensing end portion opposite said loading end portion and positioned above said mixing drum;

said support track including a fixed track portion coupled to said transport frame and positioned directly above said transport frame, and a repositionable track portion that comprises said loading end portion and is repositionable relative to said fixed track portion, wherein said loading end portion is configured to be at least partially supported by the ground surface when said repositionable track portion is coupled to said fixed track portion to form said support track;

a drive system associated with said support track and configured to move said movable supply hopper between said loading and dispensing end portions of said support track;

wherein said upper end portion of said movable supply hopper is positioned above said support track and said lower dispensing portion of said movable supply hopper is positioned below said support track;

wherein said movable supply hopper maintains a substantially fixed orientation relative to said support track at said loading and dispensing end portions of said support track and while moving between said loading and dispensing end portions of said support track; and wherein said upper end portion of said movable supply hopper is configured to receive the premix concrete from a source when said supply hopper is positioned at said loading end portion of said support track, and said lower dispensing portion of said supply hopper is configured to dispense the premix concrete into said mixing drum when said movable supply hopper is positioned at said dispensing end portion of said support track.

2. The transportable concrete mixing apparatus according to claim 1, wherein said repositionable track portion is positioned rearwardly of said fixed track portion when said fixed and repositionable track portions are coupled to form said support track, said repositionable track portion being releasably coupled to said fixed forward track portion at a junction.

3. The transportable concrete mixing apparatus according to claim 2, wherein said repositionable track portion is stowable along one of said transport frame and said fixed track portion when said repositionable track portion is de-coupled from said fixed track portion, for transporting said mixing apparatus.

4. The transportable concrete mixing apparatus according to claim 3, wherein said support track comprises a pair of spaced rails, each of said rails configured to support a respective side of said movable supply hopper.

5. The transportable concrete mixing apparatus according to claim 1, wherein said drive system comprises a winch at said support track.

6. The transportable concrete mixing apparatus according to claim 1, further comprising a concrete pump, wherein said mixing drum is operable to dispense the mixed flowable concrete into said concrete pump, and wherein said concrete pump is operable to pump the mixed flowable concrete to a location spaced from said apparatus.

7. The transportable concrete mixing apparatus according to claim 6, wherein said mixing drum comprises a pair of pivotally mounted mixing drums each having a respective open mouth at an axial end and along a rotational axis thereof, wherein each of said mixing drums is pivotable between a mixing orientation and a dispensing orientation, wherein said lower dispensing portion of said supply hopper is positioned at least partially inside said open mouth of one of said mixing drums when said one of said mixing drums is at said mixing orientation and said supply hopper is at said dispensing end portion of said support track.

8. The transportable concrete mixing apparatus according to claim 7, wherein said mixing drums alternately mix concrete and dispense mixed flowable concrete into said concrete pump.

9. The transportable concrete mixing apparatus according to claim 1, further comprising a water tank configured to supply the water to said mixing drum for wetting the premix concrete and forming the mixed flowable concrete.

10. The transportable concrete mixing apparatus according to claim 1, further comprising:

a hydraulic motor configured to rotate said mixing drum about a longitudinal axis;

a hydraulic pump configured to drive said hydraulic motor;

an electrical generator for generating electricity; and an internal combustion engine configured to drive said hydraulic pump and said electrical generator.

11. The transportable concrete mixing apparatus according to claim 1, wherein said movable supply hopper comprises a carriage for engaging said support track and for movably supporting said movable supply hopper along said support track, and a power actuated slide gate at said lower dispensing portion of said movable supply hopper for selectively dispensing the premix concrete from said supply hopper.

12. The transportable concrete mixing apparatus according to claim 11, further comprising a controller in communication with and operable to control each of said drive system, said mixing drum, and said slide gate, wherein said controller is operable to effect substantially automated operation of said transportable concrete mixing apparatus.

13. The transportable concrete mixing apparatus according to claim 1, wherein said support track is arranged at an incline with said dispensing end portion positioned at a higher elevation than said loading end portion.

14. The transportable concrete mixing apparatus according to claim 13, wherein said dispensing end portion of said support track is positioned above said mixing drum and said loading end portion of said support track is positioned below said mixing drum.

15. The transportable concrete mixing apparatus according to claim 1, wherein said transport frame comprises a wheeled trailer frame configured to be conveyed along a road surface and a pivotable base frame on which at least said mixing drum, said support track, and said movable supply hopper are mounted, wherein said base frame is pivotable relative to said wheeled trailer frame for leveling said base frame when said wheeled trailer frame is on a non-level surface.

16. A transportable concrete mixing apparatus comprising:

a transport frame;

at least one mixing drum pivotably supported at said transport frame and operable to receive premix concrete through an open mouth at an axial end thereof when at a mixing orientation in which said axial end is raised, to mix the premix concrete with water to form mixed flowable concrete, and to dispense the mixed flowable concrete through said axial end at a dispensing orientation in which said axial end is lowered relative to said mixing orientation;

a supply hopper configured to contain the premix concrete, said supply hopper having an upper end portion and a dispensing portion configured to selectively dispense the premix concrete therefrom;

a support track for movably supporting said supply hopper, said support track having a fixed forward track portion and a separable rearward track portion, wherein said forward track portion is coupled to said transport frame and positioned directly above said transport frame, and comprises a dispensing end portion of said support track that is positioned above at least a portion of said mixing drum, and wherein said separable rearward track portion comprises a loading end portion of said support track that is spaced laterally away from said transport frame, said support track being reconfigurable between (i) an in-use configuration in which said separable rearward track portion is at least partially supported by a ground surface spaced laterally away from said transport frame, and (ii) a stowed transport configuration in which said support track is fully supported by said transport frame;

a carriage at said supply hopper for movably supporting said supply hopper along said support track with said upper end portion of said movable supply hopper positioned above said support track and said lower dispensing portion of said movable supply hopper positioned below said support track, wherein said carriage is configured to maintain said movable supply hopper in a substantially fixed orientation relative to said support track at both said loading and dispensing end portions of said support track and while moving between said loading and dispensing end portions of said support track;

a drive system positioned near said dispensing end portion of said support track and coupled to said supply hopper, said drive system configured to move said supply hopper between said loading and dispensing end portions of said support track when said support track is in said in-use configuration;

wherein when said supply hopper is positioned at said dispensing end portion of said support track by said drive system, said dispensing portion of said movable supply hopper is positioned at said open mouth of said mixing drum in said mixing orientation and is operable to dispense the premix concrete into said mixing drum; and a controller in communication with and operable to control each of said drive system, said mixing drum, and said dispensing portion of said supply hopper, wherein said controller is operable to effect substantially automated operation of said transportable concrete mixing apparatus by controlling said drive system, said mixing drum, and said dispensing portion of said supply hopper in a coordinated manner.

17. The transportable concrete mixing apparatus of claim 16, wherein:

said at least one mixing drum comprises left and right mixing drums;

said support track comprises a left and right support tracks, each of said support tracks corresponding to a respective one of said left and right mixing drums;

said movable supply hopper comprises left and right movable supply hoppers, each of said supply hoppers being movably supported on a respective one of said left and right support tracks;

said drive system comprises left and right drive systems, each of said drive systems corresponding to a respective one of said left and right support tracks and said left and right supply hoppers; and wherein said left mixing drum, said left support track, said left supply hopper, and said left drive system is operable independently of said right mixing drum, said right support track, said right supply hopper, and said right drive system.

18. A method of preparing mixed flowable concrete, said method comprising:

providing a transport frame, a mixing drum coupled to the transport frame, a support track, a supply hopper movably supported at the support track, and a drive system, the support track having a fixed track portion and a repositionable track portion, wherein the fixed track portion includes a dispensing end portion of the support track and is coupled to the transport frame and positioned directly above the transport frame, and the repositionable track portion includes a loading end portion of the support track;

positioning the support track with the loading end portion supported by a ground surface at a location spaced laterally away from the transport frame and below the mixing drum, and the dispensing end portion positioned above at least a portion of the mixing drum;

positioning the supply hopper at the loading end portion of the support track, the supply hopper having an upper end portion above the support track and a dispensing portion below the support track;

providing a container of premix concrete;

dispensing the premix concrete from the container into the supply hopper;

moving the supply hopper to the dispensing end portion of the support track with the drive system while maintaining the supply hopper in a fixed orientation relative to the support track, to thereby position the dispensing portion of the support hopper at an open mouth of the mixing drum at an axial end thereof;

dispensing the premix concrete from the dispensing portion of the support hopper into the mixing drum while maintaining the supply hopper in a fixed orientation relative to the support track;

dispensing water into the mixing drum;

mixing the premix concrete with the water in the mixing drum; and dispensing mixed flowable concrete from the mixing drum.

19. The method of claim 18, wherein said providing the mixing drum comprises providing a first mixing drum and a second mixing drum.

20. The method of claim 19, wherein said dispensing the premix concrete from the supply hopper into the mixing drum comprises:

dispensing the premix concrete from the supply hopper into the first mixing drum;

moving the supply hopper to the loading end portion of the support track with the drive system;

providing a second container of premix concrete;

dispensing the premix concrete from the second container into the supply hopper;

moving the supply hopper to the dispensing end portion of the support track with the drive system; and dispensing the premix concrete from the supply hopper into the second mixing drum.

21. The method of claim 19, wherein said dispensing the premix concrete from the supply hopper into the mixing drum comprises:

selectively dispensing into the first mixing drum only a portion of the premix concrete from the supply hopper; and selectively dispensing into the second mixing drum another portion of the premix concrete from the supply hopper.

22. The method of claim 18, further comprising:

prior to said dispensing the premix concrete from the support hopper, prior to said dispensing water, and prior to said mixing the premix concrete with water in the mixing drum, measuring the weight of the premix concrete in the container or in the supply hopper;

comparing the measured weight of the premix concrete in the container or in the supply hopper to a previously-measured weight of the premix concrete in the container in order to determine a measured weight difference; and wherein said mixing the premix concrete with water in the mixing drum comprises adjusting the amount of water in the mixing drum according to the measured weight difference.

23. The transportable concrete mixing apparatus of claim 16, further comprising:

a weigh scale operable to measure a current weight of the premix concrete added to said movable supply hopper, wherein said weigh scale is in communication with said controller;

a sensor operable to detect a prior recorded original weight of the premix concrete, wherein said sensor is in communication with said controller; and wherein said controller is operable to adjust the amount of the water added to said mixing drum by an amount substantially corresponding to the difference between the prior recorded original weight of the premix concrete and the measured current weight of the premix concrete added to said movable supply hopper.

* * * * *